US008083559B1

(12) United States Patent
Keller

(10) Patent No.: US 8,083,559 B1
(45) Date of Patent: Dec. 27, 2011

(54) WATER BOARD COVER APPARATUS AND ASSOCIATED METHOD

(76) Inventor: Gary S. Keller, Big Bear City, CA (US)

( * ) Notice: Subject to any disclaimer, the term of this patent is extended or adjusted under 35 U.S.C. 154(b) by 280 days.

(21) Appl. No.: 12/454,757

(22) Filed: May 22, 2009

Related U.S. Application Data

(60) Provisional application No. 61/128,870, filed on May 27, 2008.

(51) Int. Cl.
*B63B 1/00* (2006.01)

(52) U.S. Cl. ..... 441/65; 441/74; 224/581

(58) Field of Classification Search ..... 441/65, 441/74, 75; 114/219, 361; 206/315.1; 224/586, 224/581
See application file for complete search history.

(56) References Cited

U.S. PATENT DOCUMENTS

| | | | | | |
|---|---|---|---|---|---|
| 3,339,607 | A | * | 9/1967 | Howard | 441/74 |
| 4,586,451 | A | * | 5/1986 | Mori | 441/74 |
| 4,719,952 | A | * | 1/1988 | Geronimo | 441/74 |
| 5,014,955 | A | * | 5/1991 | Thompson | 441/74 |
| 5,033,497 | A | * | 7/1991 | Hernandez | 441/74 |
| 5,122,085 | A | | 6/1992 | Heath | |
| 5,137,483 | A | | 8/1992 | Nealy | |
| 5,163,550 | A | * | 11/1992 | Hawk | 206/315.1 |
| 5,492,254 | A | * | 2/1996 | Challoner et al. | 224/586 |
| 6,306,000 | B1 | | 10/2001 | Parten | |

* cited by examiner

*Primary Examiner* — Lars A Olson

(57) ABSTRACT

The water board cover apparatus removably covers an existing water board so that the board can be towed behind a watercraft without the typical problem of the board's destruction. The apparatus has a top and a bottom, a front and a rear. The forward cover covers the nose of the water board. The tow loop is affixed to the front cover bottom. The bottom retainer covers the tail of the water board. The selectively connected strap assembly joins the forward cover to the bottom retainer. The bottom cover covers a part of the bottom of the water board. The bottom cover is connected to the forward cover bottom and the bottom retainer bottom.

5 Claims, 4 Drawing Sheets

WATER BOARD COVER APPARATUS AND ASSOCIATED METHOD

CROSS REFERENCE TO RELATED APPLICATIONS

This application claims the benefit of U.S. Provisional Application No. 61/128,870, filed on May 27, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates recreational water board accessories and, more particularly, to a water board cover that provides for a water board to be towed behind a power water craft.

2. Prior Art

As any surfer knows, there is nothing to compare with the experience of catching a good wave. And while we may think of surfers as standing up and riding a surfboard, in fact there are several kinds of surfing, not all of which require the standard long or short board. Body-surfers, for example, launch themselves by swimming rapidly forward on the rising crest of a wave, which they then ride through the break. One popular variant of body-surfing involves the use of an inexpensive boogie-board—a torso-length board, generally formed of Styrofoam or a similar synthetic foam, which the rider places beneath his chest and stomach and holds onto with both hands, kicking to propel himself along with the crest of a wave. Boogie-boards generally include a leash or cord which the surfer can attach to wrist or ankle, and thereby remain tethered to the board. Boogie boards are also widely known and sold as water boards.

A wake-board is of similar dimensions to a boogie-board, but is designed for towing behind a boat, and is generally composed of higher-grade materials with a correspondingly higher cost. Wake-boards are sometimes referred to as knee-boards: these have a cinch-strap which the rider, kneeling, tightens across the back of his knees or calves, enabling him to perform aerial maneuvers without leaving the board. Other wake-boards can be ridden like boogie-boards, and towed behind a boat.

Boogie-boards are cheap and versatile, and a favorite along our beaches. On inland waters, however, where the closest thing to surf is a boat wake, boogie-boards are less than satisfactory.

The invention to be described in this report came about when the inventor became frustrated in his efforts to tow boogie-boards by their leash—which doesn't work for long, as the pulling force of the tow-rope tends to pull the leash out through the Styrofoam of the board.

Conventional boogie-boards, as opposed to the more expensive wake-boards or knee-boards, are cheap, and can be found in most any discount or variety store anywhere in vicinity of a sizable body of water—that is, boogie-boards are relatively expendable, and can be replaced when they break, as sometimes they do. And while boogie boards are great for body-surfing, they are not strong enough to withstand the forces of being towed.

Accordingly, a need remains for a recreational water board cover apparatus in order to overcome the above-noted shortcomings. The present invention satisfies such a need by providing an apparatus that is convenient and easy to use, is durable yet lightweight in design, is versatile in its applications, and provides an innovative and practical recreational water board cover apparatus that

BRIEF SUMMARY OF THE INVENTION

In view of the foregoing background, it is therefore an object of the present invention to provide an apparatus for enabling a water board to be towed without its destruction. These and other objects, features, and advantages of the invention are provided by the recreational water board cover apparatus The pliable water board cover apparatus removably covers an existing water board. Water boards are typically called boogie boards, but the apparatus is not limited to embodiments covering only boogie boards. A forward cover of the apparatus preferably removably covers the nose of the water board. The forward cover may typically cover about ⅓-¼ of the water board length but is not limited to such an embodiment.

The tow loop is preferably affixed to the front cover bottom. The forward lateral retainer may be affixed rearwardly to the forward cover. The forward lateral retainer encircles the water board laterally and may be provided in adjustable length embodiments. The bottom retainer may be fitted around the tail of the board. The rear lateral retainer may be affixed perpendicularly to the bottom retainer. The rear lateral retainer may encircle the tail of the water board or in proximity thereto. The strap assembly may be disposed on the top of the apparatus.

The strap assembly may include a front strap section, a reinforcement affixing the front strap section to the forward cover top, a rear strap section affixed to a short side of the trapezoidal wedge of the bottom retainer, and a quick connect removably joining the front strap section to the rear strap section. Hook and loop may be used as the quick connect, as may various other forms of buckles and such which provide a positive connection that is easily engaged and disengaged. The bottom cover may have a rectangular cover section continued into a trapezoidal section. The rectangular cover section may be affixed to the rectangular section of the bottom retainer. The long side of the trapezoidal section may be affixed to the forward cover at the forward lateral retainer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar, with patent or legal terms or phraseology, to determine quickly from a cursory inspection the nature and essence of the technical disclosure of the application.

The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
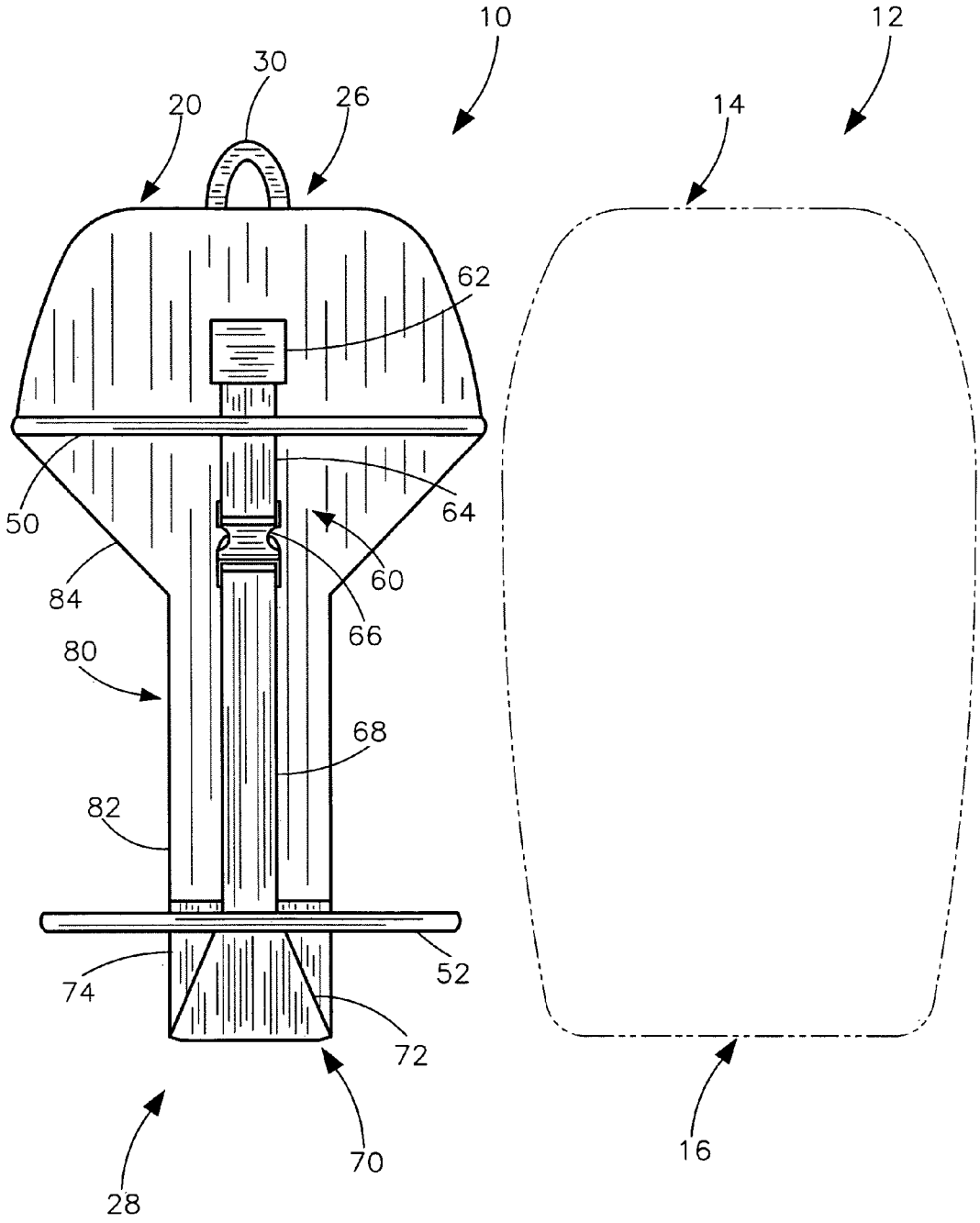
FIG. 1 is a top plan view of the recreational water board cover apparatus positioned adjacent to a water board to which it may be fitted.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in the FIGS. 1-4 by the reference numeral 10 and is intended to provide a water board cover apparatus. It should be understood that the apparatus is provided in embodiments that may be fitted to a variety of water board sizes and shapes. Various embodiments of the apparatus are further provided for fitting other similar recreational boards used in water sports.

Figure 2:
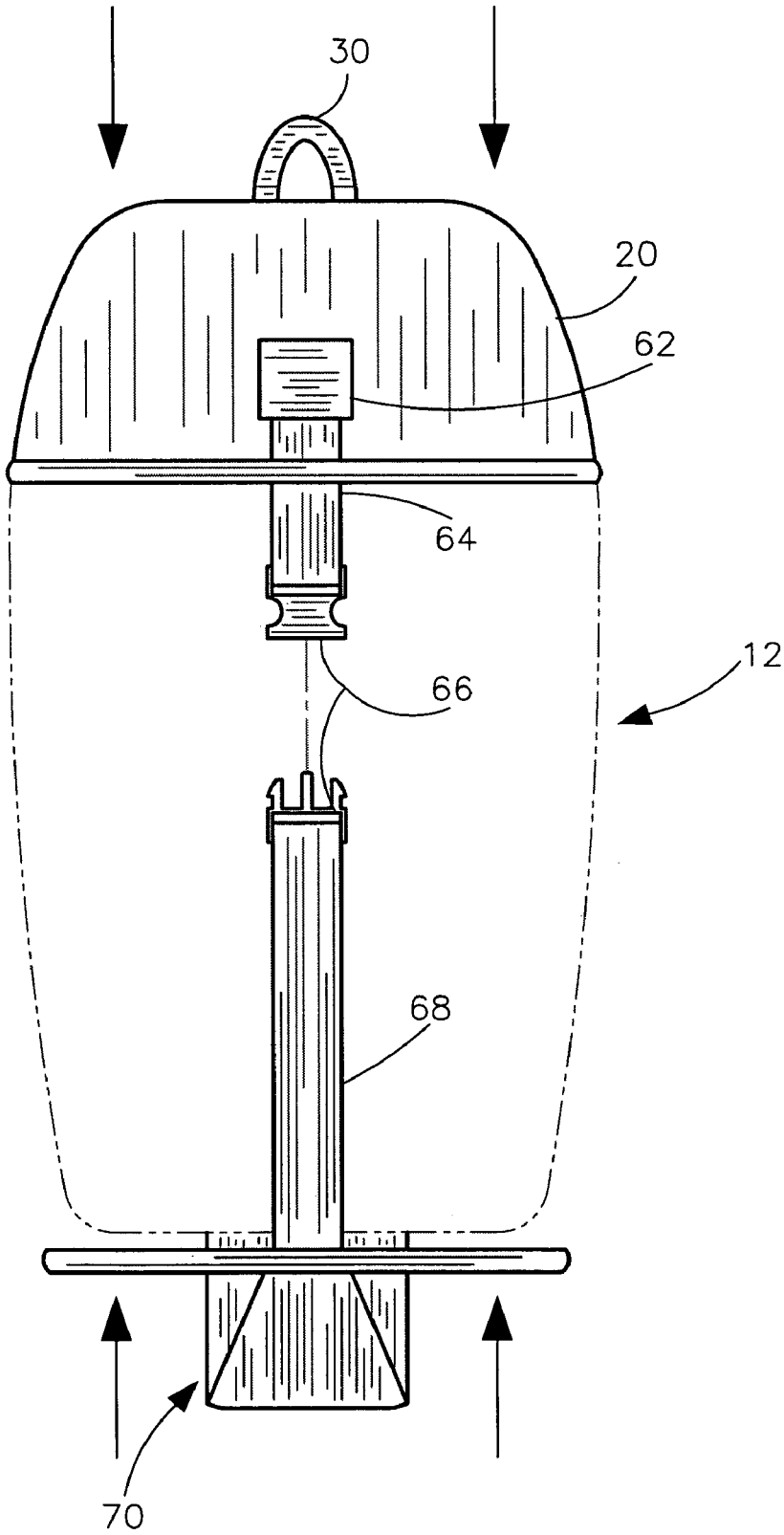
FIG. 2 is a top plan view of the recreational water board apparatus, prior to connection of the quick-connect that secures the apparatus onto the board.
Figure 3:
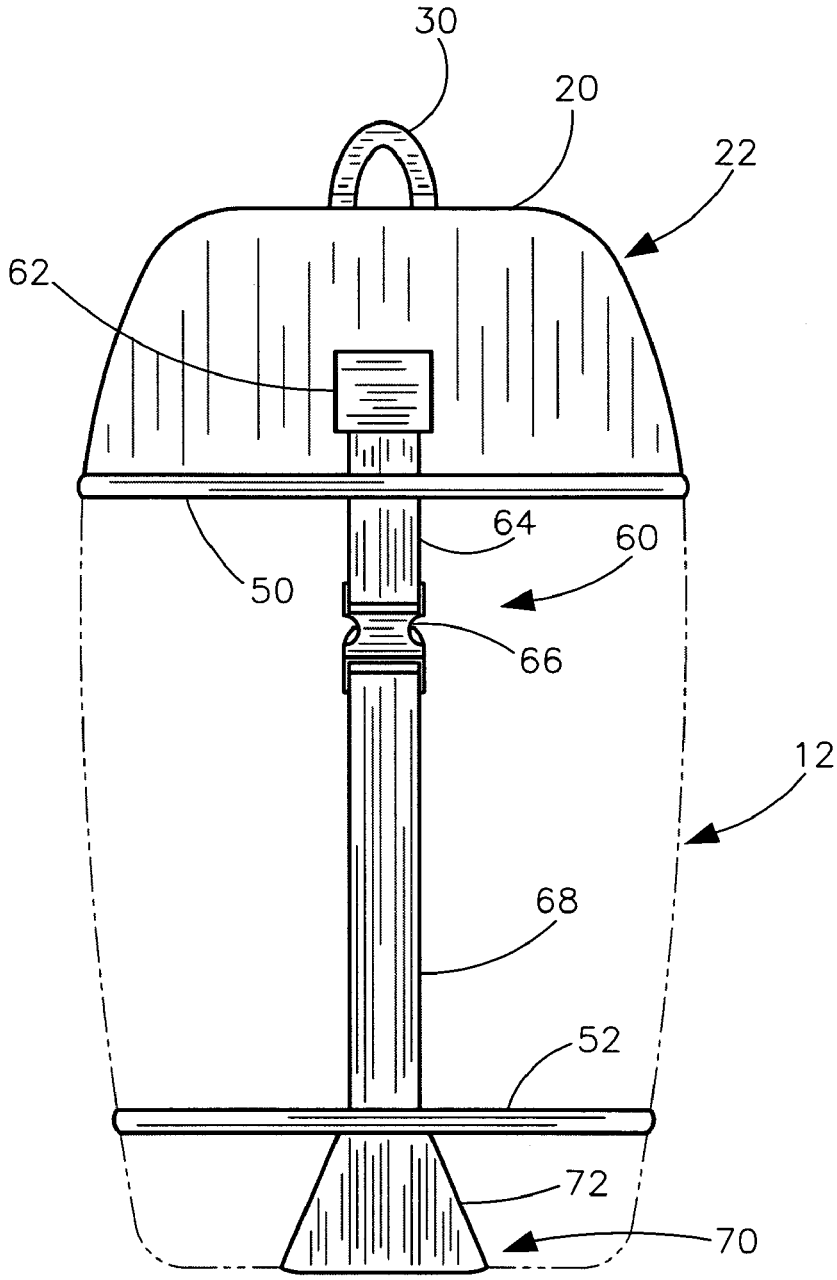
FIG. 3 is a top plan view of the apparatus installed onto the water board.

Referring to FIG. 3, the apparatus 10 removably covers an existing water board 12. The quick connect 66 joins the forward cover 20 to the rear lateral retainer 52 and the trapezoidal section 72 of the bottom retainer 70. Referring to FIG. 2, the apparatus 10 is slipped onto and off of the water board 12 and is selectively secured by the quick connect 66.

Figure 4:
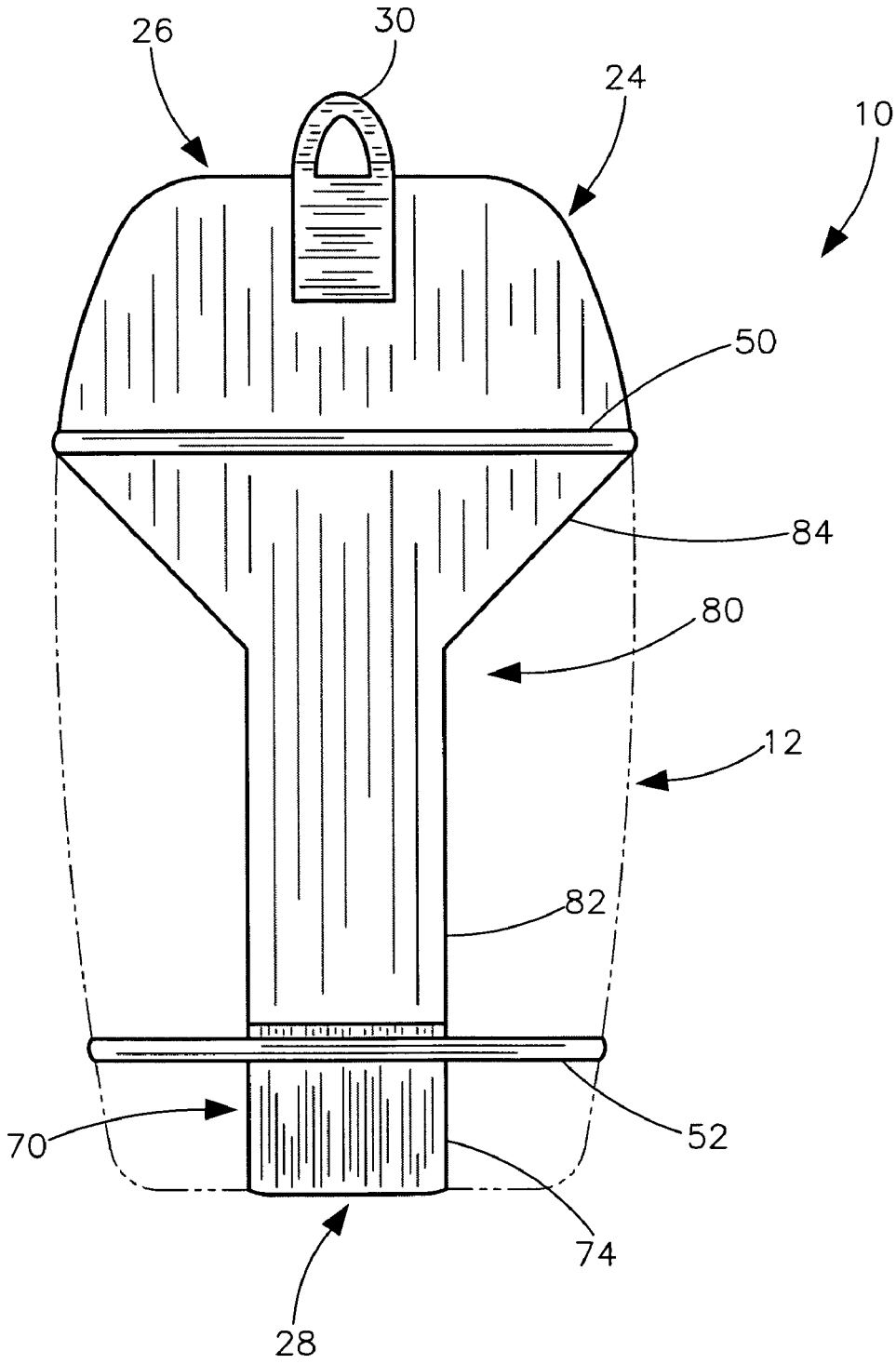
FIG. 4 is a bottom plan view of the apparatus installed onto the water board.

Referring again to FIG. 3 and also to FIGS. 1 and 4, the apparatus 10 includes the top 22 and the bottom 24, and the front 26 spaced apart from the rear 28. The pliable forward cover 20 covers the nose 14 of the water board 12. The tow loop 30 is statically affixed to the front 26 cover 20. Such a top 22 and bottom 24 may be coextensively shaped and thereby are adapted to evenly cover an equal surface area of the water board 12. Such a front 26 has a width that is greater than a width of the rear 28 so that tensioning and operating forces are laterally distributed from the rear 28 towards the front 26 for assisting a rider to maneuver the front 26 during towing.

In particular, the tow loop 30 is statically affixed to the bottom 24 of the front 26 cover 20 for towing a rider. The forward lateral retainer 50 is affixed rearwardly to the forward cover 20. In this manner, the forward lateral retainer 50 laterally encircles the water board 12. The bottom retainer 70 is fitted around the tail 16 of the water board 12. The bottom retainer 70 has a trapezoidal wedge 72 continued into the rectangular section 74. Such a transition from the trapezoidal wedge 72 to the rectangular section 74 overcomes the problem of premature and undesirable laterally shifting of the bottom retainer 70, which can lead to disengagement of the bottom retainer 70 from the water board 12.

In particular, the trapezoidal wedge 72 distributes tensioning and operating forces along the rear lateral retainer 52 and thereby cooperates with bottom retainer 70 and cover section 82 to absorb multi-directional tugging and pulling during operating conditions. The forward and rear lateral retainers 50, 52 may be formed from deformably resilient material for maintaining a firm engagement with the water board 12.

The trapezoidal wedge 72 is on the apparatus 10 top 22. The rectangular section 74 is on the apparatus 10 bottom 24. The rear lateral retainer 52 is statically affixed perpendicularly to the bottom retainer 70 and encircles the tail 16 of the water board 12. The strap assembly 60 is affixed to the forward cover 20 top 22. The strap assembly 60 comprises the front strap section 64 affixed to the forward cover 20 top 22. The reinforcement 62 affixes the front strap section 64 to the forward cover 20 top 22.

The rear strap section 68 is affixed to the short side of the trapezoidal wedge 72 of the bottom retainer 70. The quick connect 66 removably joins the front strap section 64 to the rear strap section 68. The bottom cover 80 has a rectangular cover section 82 continued into the trapezoidal section 84. The rectangular cover section 82 is affixed to the rectangular section 74 of the bottom retainer 70. Such a bottom retainer 70 is formed from deformably resilient material and thereby absorbs tensioning and operating forces during towing. Such a bottom cover 80 is intercalated between the bottom retainer 70 and the forward cover 20.

The long side of the trapezoidal section 84 is affixed to the forward cover 20 at the forward lateral retainer 50. Such a structural configuration evenly distributes tensioning and operating forces exerted on the bottom cover 80 while skimming along the water. By evenly distributing the tensioning and operating forces outwardly and away from a center of the front cover, the rider is able to more accurately maneuver and leverage the front of the water board 12 between raised, lowered and tilted positions during towing.

The apparatus 10, as claimed, provides the unexpected and unpredictable benefit of lifting the front of the water board during towing, enabling the board to skim the water better, instead of plowing. The benefit is further fully realized upon initiation of towing. The combination of such claimed elements provides an unpredictable and unexpected result that is not rendered obvious by one skilled in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A water board cover apparatus removably covering an existing water board, the water board cover apparatus comprising:

a top and a bottom;

a pliable front spaced apart from a rear;

a forward cover adapted to removably cover a nose of the water board;

a tow loop affixed to the forward cover;

a forward lateral retainer affixed rearwardly to the forward cover, the forward lateral retainer adapted to laterally encircle the water board;

a bottom retainer fitted around a tail of the water board, the bottom retainer having a trapezoidal wedge continued into a rectangular section, the trapezoidal wedge adapted to lay on the apparatus top, the rectangular section on the apparatus bottom respectively;

a rear lateral retainer affixed perpendicularly to the bottom retainer, the rear lateral retainer adapted to encircle a tail of the water board;

a strap assembly disposed on the top, the strap assembly comprising:

a front strap section, a reinforcement affixing the front strap section to the forward cover, a rear strap affixed to a short side of the trapezoidal wedge of the bottom retainer, and a quick connect removably joining the front strap section to the rear strap section; and a bottom cover having a rectangular cover section continued into a trapezoidal section, the rectangular cover section affixed to the rectangular section of the bottom retainer, a long side of the trapezoidal section affixed to the forward cover at the forward lateral retainer.

2. The water board cover apparatus according to claim 1, wherein the top and the bottom are coextensively shaped and thereby are adapted to evenly cover an equal surface area of the water board.

3. The water board cover apparatus according to claim 1, wherein the front has a width that is greater than a width of the rear so that tensioning and operating forces are laterally distributed from the rear towards the front for assisting a rider to maneuver the front during towing.

4. The water board cover apparatus according to claim 1, wherein said bottom retainer is formed from deformably resilient material and thereby absorbs tensioning and operating forces during towing.

5. The water board cover apparatus according to claim 1, wherein the bottom cover is intercalated between the bottom retainer and the forward cover.

* * * * *